United States Patent [19]

Carnahan et al.

[11] 4,098,866

[45] Jul. 4, 1978

[54] RECOVERY OF URANIUM FROM REFRACTORY ORES

[75] Inventors: Thomas G. Carnahan; Kenneth P. V. Lei, both of Sparks, Nev.

[73] Assignee: The United States of America as represented by the Secretary of the Interior, Washington, D.C.

[21] Appl. No.: 788,060

[22] Filed: Apr. 15, 1977

[51] Int. Cl.[2] ..... C01G 43/00

[52] U.S. Cl. ..... 423/7; 423/20

[58] Field of Search ..... 423/7, 20

[56] References Cited

U.S. PATENT DOCUMENTS

| | | | |
|---|---|---|---|
| 3,309,140 | 3/1967 | Gardner et al. | 423/20 |
| 3,777,004 | 12/1973 | Lankenau et al. | 423/20 |
| 3,801,694 | 4/1974 | Pace et al. | 423/20 |

*Primary Examiner*—Edward A. Miller

*Attorney, Agent, or Firm*—William S. Brown; Donald A. Gardiner

[57] ABSTRACT

Uranium is recovered from refractory carbonaceous-sulfidic ores or concentrates by leaching with nitric acid, followed by sorption on an ion exchange resin. In addition, the nitric acid leach solution is regenerated and recycled.

4 Claims, No Drawings

RECOVERY OF URANIUM FROM REFRACTORY ORES

Recovery of uranium from ores or concentrates is conventionally accomplished principally by sulfuric acid leaching at temperatures of about 25° to 100° C, followed by ion exchange or solvent extraction, elution, and precipitation of a mixture of uranium oxides and sulfates. Leaching with sodium or ammonium carbonate-bicarbonate solutions is also frequently employed for treatment of ores that would require large amounts of acid. In both processes, an oxidant is added to completely oxidize the uranium to the more soluble plus 6 oxidation state. Acid leach oxidants may be $NaClO_3$, $O_2$, or $MnO_2$, with carbonate leach oxidants including $O_2$, $H_2O_2$, NaOCl or $KMnO_4$. These two processes have been used successfully for treatment of most well oxidized ores.

Other acids such as nitric or hydrochloric acid will also extract uranium from the oxidized ores, but the presence of over 1 g/l of either nitrate or chloride ion in the pregnant solution interferes with subsequent ion exchange operations. In addition, these acids are considerably more expensive than sulfuric acid, and their discharge into acquifers by percolation through the bottoms of tailings ponds may result in intolerable ground water pollution since their salts are much more soluble than corresponding sulfates.

Recently, the supply of oxidized ores has dwindled and deposits of unoxidized or semioxidized ores have been encountered with increasing frequency. These ores usually include organic carbonaceous matter and sulfidic material, such as $FeS_2$, FeS or sulfur-bearing hydrocarbon complexes, which are not present in fully oxidized ores. These unoxidized or semioxidized ores are generally not amenable to conventional leaching methods.

Applicants have now found, according to the process of the invention, that uranium may be efficiently recovered from refractory ores containing both carbonaceous and sulfidic materials by leaching with nitric acid, followed by sorption on a strong base anion exchange resin. In addition, the nitric acid leach solution is readily regenerated and recycled to the leaching step.

Applicants have found that leaching of the refractory ores employed as feed materials in the process of the invention results in formation of uranyl sulfate complexes, in contrast to the usual formation of uranyl nitrate complexes when nitric acid is employed as leachant. Although the reactions involved are complex, they appear to involve the following:

$$2MeS_2 + 10HNO_3 \rightarrow Me_2(SO_4)_3 + H_2SO_4 + 10NO + 4H_2O, \quad (1)$$

where Me is a metal, preferably iron, $$C + 2HNO_3 \rightarrow CO_2 + NO + NO_2 + H_2O, \quad (2)$$

$$2UO_2 + 2HNO_3 \rightarrow 2UO_3 + NO + NO_2 + H_2O \quad (3)$$

$$UO_3 + 2H_2SO_4 \rightarrow UO_2(SO_4)2-/2 + H_2O + 2H^+. \quad (4)$$

$$UO_3 + 3H_2SO_4 \rightarrow UO_2(SO_4)4-/3 + H_2O + 4H^+ \quad (5)$$

The resulting sulfate complexes are readily sorbed on strong base anion exchange resins by conventional means. In addition, the gaseous NO product is virtually insoluble in aqueous media and is readily bled from the system and reconstituted into nitric acid for recycle to the leaching step. Thus, only a small amount of residual nitrate is left in solution after the leach reaction phase of the process of the invention. In addition, the reactions involved in both the leaching step and regeneration of the nitric acid are highly exothermic, with the result that the overall process is generally nearly or completely self sufficient in energy.

Uranium ores or concentrates that may be advantageously treated according to the process of the invention will generally contain about 0.01 to 5.0 percent uranium, primarily in the form of oxides, about 0.05 to 25 percent carbonaceous matter and about 0.05 to 25 percent sulfidic material, principally metal sulfides such as pyrite. The presence of the sulfidic material has been found to be essential to efficient recovery of uranium according to the process of the invention. If a carbonaceous ore or concentrate does not contain the sulfidic material, the latter may be added to the ore in the form of a metal sulfide, preferably pyrite. The ore is preferably initially ground to about minus 35 mesh, although ore chunks of 1 inch or larger can be leached.

Optimum concentration and amount of nitric acid employed as leach solution will depend on the specific ore or concentrate treated, as well as reaction conditions such as temperature and pressure. In general the amount of acid should be sufficient to react with the carbonaceous and sulfidic matter in the ore in accordance with the above equations. Generally, concentrations of about 1 to 3 molar, with amounts sufficient to provide a pulp density of about 10 to 60 are satisfactory.

Reaction temperatures in the leaching step may be from about 20° to 200° C, but temperatures of about 80° to 140° C are generally preferred since they provide rapid and complete reacion. Reaction pressure can be maintained at any value above the vapor pressure of the aqueous solution at the operating temperature, with values of about 35 psig over the water vapor pressure generally being a convenient working pressure. Optimum reaction time will vary with temperature, as well as type and particle size of the ore. Reaction times of a little as 15 minutes or as long as 24 hours may be optimum depending on these variables. Generally, however, a reaction time of about 1–5 hours is sufficient. Stirring at a rate sufficient to maintain the ore pulp in suspension is generally sufficient.

The pregnant leach solution is separated from the residue by conventional means such as filtration, and is then purified by contact with a strong base anion exchange resin. Such resins are also conventional and are usually characterized by the presence of quaternary ammonium groups fixed to an organic polymer matrix, such as a polystyrene-divinylbenzene copolymer. These are conventionally prepared by chloromethylation of the copolymer bead, followed by reaction of the product with a tertiary amine, such as trimethylamine, to form a quaternary ammonium salt.

The resin is generally employed in the form of a column through which the pregnant leach solution is passed, whereby the anions of the resin exchange with the complex uranyl sulfate anions resulting from equations (3) and (4), above. Optimun dimensions of the column, mesh size of the resin and rate of elution will all depend on the amount and specific composition of the pregnant leach solution, desired purity of product, etc, and are readily determined experimentally.

Desorption of the uranium from the resin is conventionally accomplished by elution with a solution of sodium chloride or ammonium nitrate, and the uranium is then precipitated as a mixed oxy-sulfate product commonly called "yellow cake" by neutralization with ammonia or magnesia.

Regeneration of the nitric acid leach solution is readily accomplished by oxidation of the nitric oxide produced by reactions (1) and (2) above according to the reactions:

$$NO + 1/2O_2 \rightarrow NO_2 \quad (6)$$

$$3NO_2 + H_2O \rightarrow 2HNO_3 + NO \quad (7).$$

Thus, nitric acid is continuously recycled within the system. Regeneration of the nitric acid can, if desired, be accomplished within the leach reaction chamber by addition of an oxygen-containing gas, e.g., air or pure oxygen, since the acid regeneration reactants, nitric oxide and water, are present either in the slurry or in the gas space above the slurry.

The process of the invention, and the advantages thereof, will be more specifically illustrated by the following examples.

EXAMPLES 1-9

A series of leaching tests was conducted with 200 ml of sulfuric acid, sodium carbonate-bicarbonate, or nitric acid solutions on 100 g charges of a uranium ore containing 0.16 pct U, 6.6 pct organic carbon, and 8.8 pct sulfur which was primarily in the sulfide form chemically combined with iron as pyrite, $FeS_2$. Stirring rate was 600 rpm and overpressure for nitric acid tests was maintained at 50 psig. Results are shown in Table 1.

Table 1.

| Ex. | Leach solution composition | Time, hr | Temperature, °C | U extraction, pct |
|---|---|---|---|---|
| (1) | 0.125 M $H_2SO_4$ + 0.005 M $NaClO_3$ | 24 | 25 | 12.5 |
| (2) | 0.10 M $H_2SO_4$ + 0.009 M $NaClO_3$ | 1 | 120 | 51.0 |
| (3) | 0.5 M $Na_2CO_3$ + 0.20 M $NaHCO_3$ | 4 | 25 | 30.5 |
| (4) | 0.5 M $Na_2CO_3$ + 0.20 M $NaHCO_3$ | 4 | 125 | 69.5 |
| (5) | 1.25 M $HNO_3$ | 24 | 25 | 18.5 |
| (6) | 2.5 M $HNO_3$ | 1 | 120 | 77.3 |
| (7) | 3.0 M $HNO_3$ | 1 | 130 | 89.0 |
| (8) | 1.90 M $H_2SO_4$ + 0.009 M $NaClO_3$ | 1 | 120 | 53.5 |
| (9) | 5.30 M $H_2SO_4$ + 0.009 M $NaClO_3$ | 1 | 120 | 65.8 |

As seen in Table 1, all leachants required temperatures above 100° C for high extractions from this ore, and nitric acid extracted the most uranium. The increasing amounts of $HNO_3$ as temperature increased were required because of more complete reaction of ore and acid at the higher temperatures. The small amount of sulfuric acid used in examples 1 and 2 was sufficient for all sulfuric acid consuming reactions. Additional sulfuric acid served no purpose and was left as free acid in the leach solution. This is shown in example 9 where uranium extraction, even at 5.3 M $H_2SO_4$, is not as great as for nitric acid leaching under the same conditions.

EXAMPLE 10

This example illustrates processing of leach solutions by ion exchange and recovery of "yellow cake" by neutralization of the pregnant ion exchange eluate. 94 pct of the uranium was leached from an ore containing 0.50 pct U, 8.91 pct organic carbon, and 6.3 pct sulfur primarily as pyrite, $FeS_2$. Leaching was performed at 120° C with 3.0 M nitric acid. The pregnant solution contained 0.0057 M U, 0.20 M Fe, 0.33 M $SO_4^{=}$, 0.005 M $NO_3^-$, and had a pH of 0.90.

The leach solution was applied to a column of minus 20 plus 50 mesh strong base anion exchange resin of the type described above at a flow rate of 0.75 to 1.0 gal/min/ft$^3$ until the effluent solution from the column contained the same uranium concentration as the influent solution. The resin loaded to 2.8 lb U/ft$^3$ of resin which is representative of commercial loadings. Elution was accomplished with 1 M NaCl solution acidified to pH 1.14 with $H_2SO_4$. Over 96 pct of the uranium was stripped from the resin with 10 bed volumes of the eluant. The strip solution was neutralized to pH 7.0 with $NH_4OH$ and filtered. The "yellow cake" product contained 56.2 pct U.

EXAMPLE 11

One-hundred grams of minus 35 mesh ore containing 0.16 pct U, 6.6 pct organic carbon, and 8.8 pct sulfur which was primarily in the sulfide form chemically combined with iron as pyrite was mixed with 500 ml of 0.32 M $HNO_3$ solution and stirred at 600 rpm under 100 psig of oxygen at 120° C for 1 hour. A total of 88 pct of the uranium was extracted, and the solution contained a nitrate concentration of 0.27 M $NO_3^-$. A duplicate experiment under the inert gas, argon, extracted only 31 pct of the uranium, and the nitrate concentration left in solution was only 0.018 M $NO_3^-$. Thus, for the case where an oxygen or air overpressure is maintained, a high percentage of the uranium is extracted and the nitric acid leach solution is regenerated.

We claim:

1. A process for recovery of uranium from a refractory ore or concentrate containing about 0.05 to 25 percent carbonaceous material and about 0.05 to 25 percent sulfidic material comprising treating the ore or concentrate with a nitric acid solution at a temperature of about 80° to 140° C to provide a uranium-containing leach solution.

2. The process of claim 1 in which the sulfidic material consists essentially of pyrite.

3. The process of claim 1 in which the uranium-containing leach solution is subsequently purified by contacting with a strong base anion exchange resin to absorb the uranium, followed by desorption of the uranium by means of a stripping solution.

4. The process of claim 1 in which the nitric acid leach solution is regenerated by oxidation of nitric oxide formed in the leaching process.

* * * * *